United States Patent [19]

Swearingen et al.

[11] Patent Number: 4,579,246

[45] Date of Patent: Apr. 1, 1986

[54] CLOSURE FOR A FLEXIBLE CONTAINER

[76] Inventors: David W. Swearingen, 2003 Chorro, San Luis Obispo, Calif. 93401; Barnard McCloskey, 584 Via LaBarranca, Arroyo Grande, Calif. 93420

[21] Appl. No.: 643,010

[22] Filed: Aug. 22, 1984

Related U.S. Application Data

[63] Continuation of Ser. No. 455,328, Jan. 3, 1983.

[51] Int. Cl.[4] ..... B65D 51/22

[52] U.S. Cl. ..... 220/258; 220/335; 220/334; 53/485; 229/44 R

[58] Field of Search ..... 220/255, 258, 335, 334; 229/44 R; 53/485

[56] References Cited

U.S. PATENT DOCUMENTS

| | | | |
|---|---|---|---|
| 3,282,477 | 11/1966 | Henchert | 220/258 |
| 3,434,620 | 3/1969 | Laurizio | 220/258 |
| 3,537,610 | 11/1970 | Bilon | 220/258 |
| 4,094,460 | 6/1978 | Scanga et al. | 220/258 |
| 4,358,025 | 11/1982 | Urion | 220/258 |
| 4,399,924 | 8/1983 | Nilsson | 220/258 |

*Primary Examiner*—Joseph Man-Fu Moy
*Attorney, Agent, or Firm*—Jerry N. Lulejian

[57] ABSTRACT

The present invention relates to a container constructed of a material with a stiffness coefficient of less than one-tenth (0.10) millimeter per ounce over the wall material's elastic range and having a continuous edge region defining an opening in the container, and comprises a closure and method for providing a closure which provides a substantially air-tight and reuseable seal over the entire area of the container opening, the closure and method therefor comprise; a rigid anchor means interconnectable with the edge region of the container and defining an opening for providing a path for the movement of the contents of the container through the anchor means and for providing a rigid anchor on the edge region of the container; a means for sealing the interconnection between the rigid anchor means and the edge region of the container in a substantially air-tight relation; a cover means interconnectable with the opening defined by the anchor means for covering the opening defined by the anchor means; and, a means for removably sealing the interconnection between the rigid anchor means and the cover means for providing a removeable and resealable, substantially air-tight seal of the opening defined by the anchor means.

The substantially air-tight sealing of the interconnection of the anchor means and the edge region of the container and the substantially air-tight sealing of the opening defined by the anchor means both act to provide a substantially air-tight and reuseable seal of the container opening.

21 Claims, 9 Drawing Figures

CEREAL

CLOSURE FOR A FLEXIBLE CONTAINER

BACKGROUND OF THE INVENTION

This a continuation application to application No. 06/455,328, filed Jan. 3, 1983.

The present invention relates to closures and a method for providing such a closure for containers and more specifically relates to closures and methods for providing such closures for containers constructed of flexible materials.

The supermarkets and other stores are full of food products and other moisture and bacteria sensitive products which are packaged in flexible containers. These containers are typically constructed of paperboard (hereinafter referred to as "the paperboard box" without limiting the invention to containers constructed of paperboard). The problem with the paperboard box is that after it is first opened, the contents are forever thereafter exposed to the open air and its moisture and bacteria. The opening in the box is also prone to insect invasion. The contents are exposed to the open air and insects because no one has been able to develop a closure for the flexible paperboard box which will provide a removeable, reuseable, and substantially air-tight closure.

It has never been a problem to provide an air-tight seal of the paperboard box when the box is first manufactured because one need only glue the opening together. However, until the present invention, there has never been a removeable, reuseable, and substantially air-tight closure for containers constructed of flexible paperboard and other flexible materials which house the majority of all food and moisture sensitive products.

The typical paperboard box 10 will normally have a bottom flap which folds under a top flap, and the two flaps are typically interconnected with a notch and tab when the two flaps are manually folded, one on top of the other.

It can be understood that when the two flaps are interconnected, they do not form an air-tight seal of the box opening. In fact, there are significant gaps between the flaps themselves and the edges of the flaps and the edge region of the box opening. Air and its moisture and bacteria as well as insects will easily be able to attack the contents of the box even though the flaps are interconnected.

To aid in this problem, manufacturers of paperboard boxes such have provided an inner lining typically constructed of a flexible wax paper material. The lining is folded and unfolded along its upper border to close and open the lining and to provide some sort of sealing for the contents of the box. However, the inner lining is burdensome to the user of the box. In addition, the lining is rarely effective in providing an air-tight compartment for the contents of the box either because the lining tears before the contents are gone or because it is difficult for the user to reach inside the box to perfectly fold the lining as is required to provide even a reasonable seal to protect the contents.

Another method of providing a reuseable closure for the typical box is to provide a spout which is interfit to the box. The spout is manually closeable and openable by rotating its face about an axis line so that the face of the spout is moved in abutting relation to the side of the box or is rotated away from the side of the box, respectively. This spout cannot provide an air-tight compartment for the contents of the box because there will always be gaps between the sides of the spout and the side of the flexible box. In addition, the edge of the spout across which the contents pour will always leave gaps against the side of the flexible box when the spout is in the closed position. Thus, the spout, although convenient, cannot provide an air-tight seal of the flexible box.

It appears quite clear that there has been no closure or method of providing a closure that provides an removeable, reuseable and substantially air-tight closure for a container having flexible walls. Such an invention would be of tremendous value. The reader might recall a recent time when a food product had gone stale or was invaded by insects while the food product was housed in the above described prior art box. If a closure and method of providing a removeable, reusable and substantially air-tight closure were invented, there would be tremendous cost savings to consumers of food products and other moisture and bacteria sensitive products which must be housed in flexible containers.

The present invention is such an invention. The present invention provides a novel closure and method of providing a closure for a container constructed of a flexible material. Most containers are constructed of a flexible and light weight material such as paper board because of its light weight, cheapness and resiliency to breaking or tearing during shipment. It is to these flexible containers that the present invention is limited.

SUMMARY OF THE INVENTION

The present invention relates to containers constructed of a material with a stiffness coefficient of less than one-tenth (0.10) millimeter per ounce over the wall material's elastic range and having a continuous edge region defining an opening in the container, and the present invention comprises a closure and a method of providing a closure for providing a substantially air-tight and reuseable seal over the entire area of the container opening. The closure comprises a rigid anchor means interconnectable with the edge region of the container which defines an opening for providing a path for the movement of the contents of the container through the anchor means and provides a rigid anchor on the edge region of the container; a means for sealing the interconnection between the rigid anchor means and the edge region of the container in a substantially air-tight relation; a cover means interconnectable with the opening defined by the anchor means for covering the opening defined by the anchor means; and, a means for removably sealing the interconnection between the rigid anchor means and the cover means for providing a removeable and resealable, substantially air-tight seal of the opening defined by the anchor means.

The substantially air-tight sealing of the interconnection of the anchor means and the edge region of the container and the substantially air-tight sealing of the opening defined by the anchor means both act to provide a substantially air-tight and reusable seal of the container opening.

The anchor means typically comprises an anchor member having a flexible and continuous anchoring wall portion constructed of a material with a stiffness coefficient of less than one-tenth (0.10) millimeters per ounce over the anchoring wall material's elastic range or having a stiffness coefficient of between about three one-hundredths (0.03) millimeters per ounce over the anchoring wall material's elastic range; and, the anchoring wall is generally interconnectable in abutting relation to the edge region of the container. The anchor member has a rigid edge portion extending away from the container; and, the anchoring wall portion and the rigid edge portion of the anchor member define an opening which allows the contents of the container to move within the continuous anchoring wall and through the anchor member.

The cover means typically comprises a cover member having a rigid edge portion. The means for sealing the anchor and cover means typically comprises a means for removeably sealing the rigid edge portion of the anchor member and the rigid edge portion of the cover member in a substantially air tight sealing relation. The interconnection of the anchor member and the cover member provide a removeable, reuseable, and substantially air-tight seal of the container opening.

The rigid edge portion of the cover member typically comprises a horizontally opposed interconnecting wall portion. The outer dimensions of the anchoring wall portion of the anchor member is substantially similar to the inner dimensions of the edge region of the container. The outer dimensions of the rigid edge portion of the anchor member are substantially similar to the inner dimensions of the horizontally opposed interconnecting wall portion of the cover member; and, the means for sealing the rigid edge portions of the anchor and cover members further comprises a continuous lip portion of the anchor member protruding perpendicular to the anchoring wall portion along the periphery of the rigid edge portion of the anchor member; the lip protrudes toward the edge region of the interconnected container. The cover member also comprises a continuous lip portion of the cover member protruding inwardly along the opposed interconnecing wall portion of the cover member. The cover and anchor members come together in substantially air-tight, snap-fitting relation to provide a removeable, reuseable, and substantially air-tight seal of the container opening.

The edge region of the container, the anchoring wall of the anchor member, and the rigid edge portion of the anchor member each typically define a rectangle with each rectangle having substantially similar dimensions. In this situation, the cover member further comprises a rectangular and substantially flat covering wall portion having peripherial dimensions substantially similar to the rectangular outer dimensions of the anchoring wall of the anchor member. The continuous interconnecting wall portion extends perpendicularly from the covering wall, and, the interconnecting wall portion has the continuous lip protruding inwardly and perpendicular with the interconnecting wall portion with the continuous lip portion being horizontally opposed.

The covering wall portion of the cover member may be hinged along a line perpendicular to the sides of the rectangular covering wall portion which are of the longest length. The interconnecting wall portion of the cover member would have two breaks in continuity with each break in continuity having one point of intersection with the line of hinging of the covering wall; and, one side of the the covering wall portion and the accompanying interconnecting wall portion of the cover member are moveable from a plane defined by the substantially flat and rectangular covering wall of the cover member.

The side of the covering wall of the cover member which is moveable from the plane defined by the covering wall may be molded in a naturally tilted position, tilted from the plane defined by the rectangular covering wall. The cover member further includes a preventing means for preventing the tilted side of the covering wall from tilting away from the plane defined by the covering wall by more than a selected angle. The preventing means typically comprises two bosses each juxtaposed to the breaks in continuity of the interconnecting wall portion of the cover member on that side of the interconnecting wall which accompanies the covering wall portion and tilts away from the plane defined by the covering wall portion of the cover member.

The cover member and the anchor member are typically constructed of a plastic material. The plastic anchor member may further include a disposable sealing portion which covers the area of the anchor member defining an opening, the sealing portion being attached to the anchor member so that the area defining an opening in the anchor member is sealed in a substantially air-tight manner. The sealing portion is manually and permanently removeable from the anchor member.

DETAILED DESCRIPTION OF THE INVENTION

The supermarkets and other stores are full of food products and other moisture and bacteria sensitive products which are packaged in flexible containers. These containers are typically constructed of paperboard (hereinafter referred to as "the paperboard box" without limiting the invention to containers constructed of paperboard). The problem with the paperboard box is that after it is first opened, the contents are forever thereafter exposed to the open air and its moisture and bacteria. The opening in the box is also prone to insect invasion. The contents are exposed to the open air and insects because no one has been able to develop a closure for the paperboard box which will provide a removeable, reuseable, and substantially air-tight closure.

It has never been a problem to provide an air-tight seal of the paperboard box when the box is first manufactured because one need only glue the opening together. However, until the present invention, there has never been a removeable, reuseable, and substantially air-tight closure for containers constructed of flexible paperboard and other flexible materials which house the majority of all food and moisture sensitive products.

Figures 1A, 1B, 2, 3, 4, 5, 6:
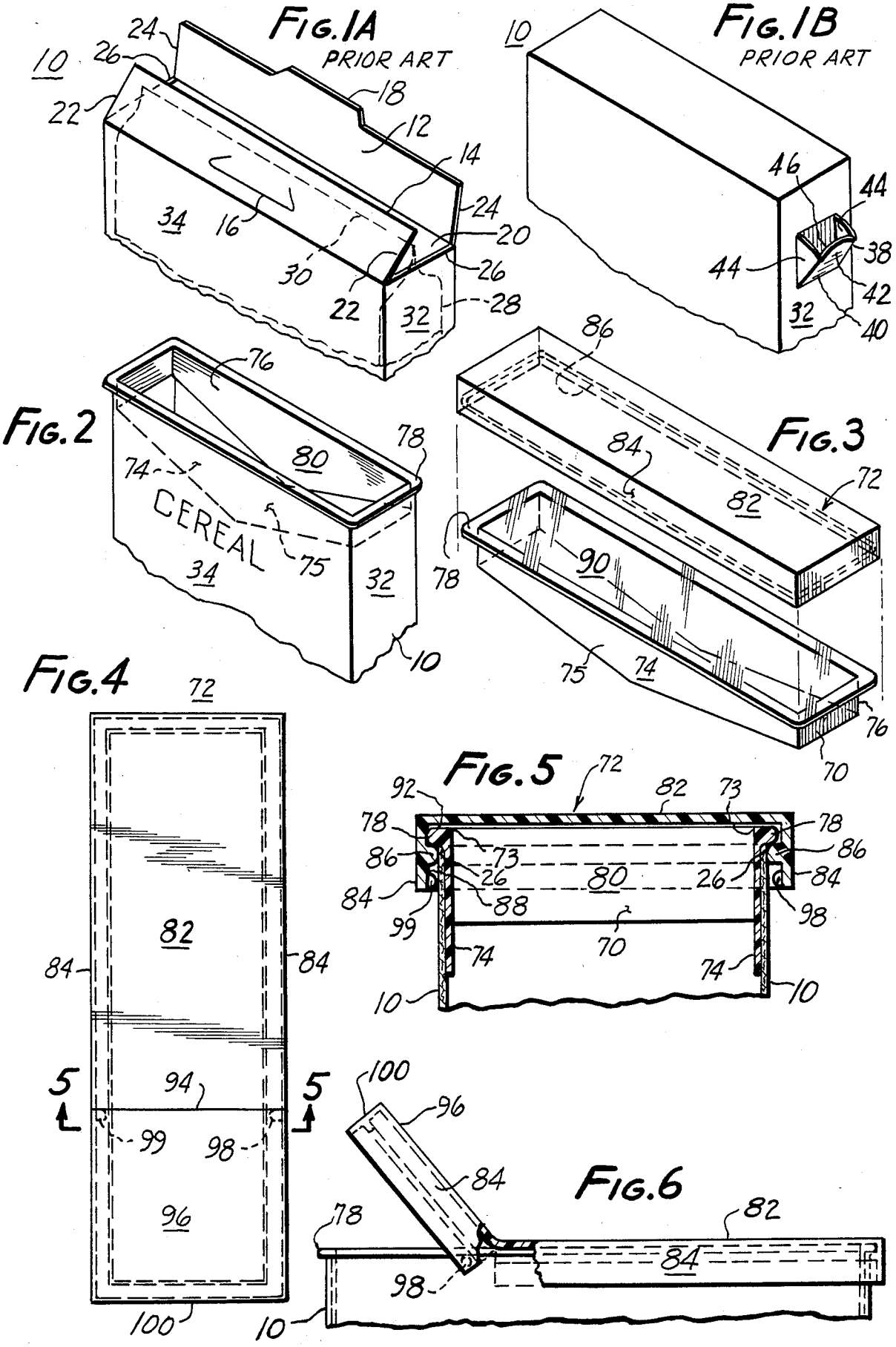
FIG. 1A PRIOR ART
FIG. 1B PRIOR ART
FIG. 1A is a perspective view of the top half of a prior art container showing two flaps as the means for closing the container.
FIG. 1B is a perspective view of the top half of a prior art container showing a spout interconnected with the container.
FIG. 2 is a perspective view of a typical box container interconnected with the anchor member of the present invention.
FIG. 3 is a perspective view of the anchor member and the cover member of the present invention.
FIG. 4 is a top view of the hinged cover member of the present invention.
FIG. 5 is a cross-sectional view of the cover member of FIG. 4 along line 5—5 of FIG. 4.
FIG. 6 is an elevational view of the hinged cover member of the present invention installed on the anchor member of the present invention.

Referring to FIG. 1A, the typical paperboard box 10 is shown. The box 10 will normally have a flap 14 which folds under a top flap 12, and the two flaps 12 and 14 are typically interconnected with a notch 16 and tab 18 when the two flaps 12 and 14 are manually folded, one on top of the other.

It can be seen that when the two flaps 12 and 14 are interconnected, they do not form an air-tight seal of the box opening 20. In fact, there are significant gaps between the flaps 12 and 14 themselves and the edges of the flaps 22 and 24 and the edge region 26 of the box 10. Air and its moisture and bacteria as well as insects will easily be able to attack the contents of the box 10 even though the flaps 12 and 14 are interconnected.

To aid in this problem, manufacturers of paperboard boxes such as box 10 have provided an inner lining 28 typically constructed of a flexible wax paper material. The lining 28 is folded and unfolded along its upper border 30 to close and open the lining 28 and to provide some sort of sealing for the contents (not shown) of the box 10. However, the inner lining 28 is burdensome to the user of the box 10. In addition, the lining is rarely effective in providing an air-tight compartment for the contents of the box 10 either because the lining 28 tears before the contents are gone or because it is difficult for the user to reach inside the box 10 to perfectly fold the lining 28 as is required to provide even a reasonable seal to protect the contents.

Referring to FIG. 1B, another method of providing a reuseable closure for the typical box 10 is to provide a spout 38 which is interfit to the box 10. The spout 38 is manually closeable and openable by rotating its face 42 about an axis line 40 so that the face 42 of the spout 38 is moved in abutting relation to the side 32 of the box 10 or is rotated away from the side 32 of the box 10, respectively. This spout 38 cannot provide an air-tight compartment for the contents (not shown) of the box 10 because there will always be gaps between the sides 44 of the spout 38 and the side of the flexible box 32. In addition, the edge 46 of the spout 38 will always leave gaps against the side 32 of the flexible box 10 when the spout 38 is in the closed position. Thus, the spout, although convenient, cannot provide an air-tight seal of the flexible box 10.

It appears quite clear that there has been no closure or method of providing a closure that provides an removeable, reuseable and substantially air-tight closure for a container constructed of a flexible material Such an invention would be of tremendous value. The reader might recall a recent time when a food product had gone stale or was invaded by insects while the food product was housed in any one of the two above described prior art boxes 10. If a closure and method of providing a removeable, reusable and substantially air-tight closure were invented, there would be tremendous cost savings to consumers of food products and other moisture and bacteria sensitive products which must be housed in cheap, tear resistant, and moisture resistant flexible containers.

The present invention is such an invention. The present invention provides a novel an unobvious closure and method of providing a closure for a container constructed of a flexible material. Most containers are constructed of a flexible and light weight material such as paper board because of its light weight, cheapness and resiliency to breaking or tearing during shipment. It is to these flexible containers that the present invention is limited.

It must be understood that the present invention is limited to use on containers having flexible walls. In order to understand exactly what is referred to as flexible walls, a test apparatus may be constructed of the type substantially similar to the test apparatus 50 shown in FIG. 8. The test apparatus 50 is designed to test for stiffness of a test sample 54. The stiffness of a material is sometimes referred to as yield strength or stiffness in bending but is precisely defined as the strain experienced by a material when incremental stresses are applied thereto over the range where the material will bounce back elastically to the same shape. The measurement of stiffness used throughout this specification and in the claims shall be the strain in millimeters per ounce of stress applied to the material; and, the ratio of strain over stress shall be the slope of the line which represents the elastic range of the material. Thus, when a material is said to have a stiffness coefficient of so many millimeters per ounce over the material's elastic range, such stiffness coefficient shall be the slope of the line plotted on a stress-strain diagram which respresents experimentally derived points indicating the amount of strain of the material for incremental amounts of stressed applied to the material. The line for which the slope ratio is calculated shall be the line representing the range of the material's elasticity.

Figure 8:
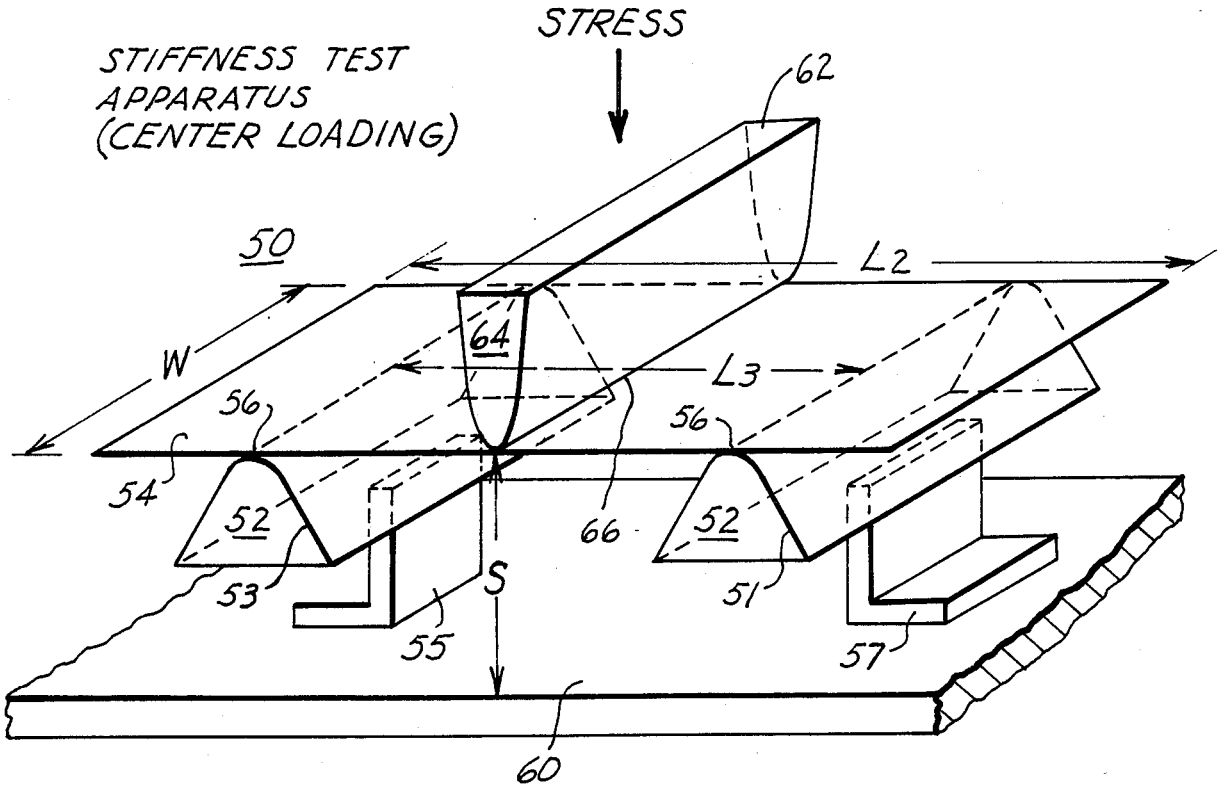
FIG. 8 is a perspective view of the test apparatus used to determine the stiffness coefficients of materials subject to the scope of the present invention.

FIG. 8 shows a perspective view of the test apparatus 50. A test sample 54 of the flexible material is placed upon two supports 51 and 53. Each support 51 and 53 has a rounded parabolic cross-section 52 and are each constructed of smooth balsa wood. The supports 51 and 53 each have a length L1 of three (3) inches. The crests 56 of the two supports 51 and 53 are separated by a length L3 of four inches.

The test sample 54 of the material is cut in a rectangular shape with a length L2 of six (6) inches and a width W of two and one-half (2.5) inches. The test sample 54 is placed across the two supports 52 so that the width W (2.5 inches) of the test sample 54 is completely supported by the three inch wide supports 51 and 53. The test sample 54 is placed such that there is one inch of overhang past each crest 56 of the two supports 51 and 53. The two supports 51 and 53 are supported above a flat surface 60, such as a table top, by angle irons 55 and 57, each embedded in one of the two supports 51 and 53. The angle irons 55 and 57 must support the supports 51 and 53 above the flat surface 60 an unstressed distance S. The distance S should be long enough to allow a measurement of all amounts of strains possible with different materials over their elastic ranges. The distance S can be from three (3) to four (4) inches for test samples 54 for the present invention.

Stresses are applied to the test sample 54 through a plunger 62 which has a sharp and pointed parabolic cross-section 64 elongated over the entire width W of the test sample 54. The travel of the plunger 62 must be in a plane perpendicular to the flat surface 60 with its sharpest side 66 extending perpendicular to and along the center of the length L2 of the test sample 54. The incremental stresses may be applied to the plunger 62 by adding incremental weights thereto. The strain can be measured along line S as the change in distance of the test sample 54 from the flat surface 60 with the addition of each incremental stress.

The claims of the present invention are limited to a container constructed of a material having a stiffness coefficient of less than one-tenth (0.10) millimeters per ounce over the material's elastic range. This particular stiffness coefficient was calculated by experimentally deriving the stiffness coefficients of the wall materials of several typical flexible containers The following chart is a listing of the results of the experiments:

STIFFNESS COEFFICIENTS OF SEVERAL MATERIALS

| Sample # | Thickness | coefficient |
|---|---|---|
| 1 | .028 in. | .2 MM/oz. |
| 2 | .028 in. | .2 MM/oz. |
| 3 | .028 in. | .3 MM/oz. |
| 4 | .026 in. | .15 MM/oz. |
| 5 | .023 in. | .40 MM/oz. |
| 6 | .021 in. | .50 MM/oz. |
| 7 | .021 in. | .70 MM/oz. |
| 8 | .018 in. | .60 MM/oz. |

Each of the samples 1 through 8 were made of paperboard of varying thicknesses and with varying amounts of resinous materials bonded to the paperboard. The varying amounts of resinous materials and the varying densities of the paperboard samples accounts for the different stiffnesses of samples having the same thickness.

It is believed that the maximum flexibility of a flexible container for which there has been no removeable, reuseable and substantially ari-tight closure or method of providing such a closure has walls constructed of a material having a stiffness coefficient of less than one-tenth (0.10) millimeter per ounce over the elastic range of the wall material. The only containers which have been able to support a closure which provides a removeable, reuseable and substantially air-tight seal of the inner contents have been metalic or highly reinforced paper containers which are constructed of materials which have a stiffness coefficient much greater than one-tenth (0.10) millimeter per ounce over the material's elastic range. Thus, the present invention has been limited to flexible containers having walls contructed from a material which has a stiffness coefficient of less than one-tenth (0.10) millimeter per ounce over the wall material's elastic range.

Referring now to FIGS. 2, 3 and 5, the properties of the closure of the present invention are shown. FIG. 3 shows a perspective view of the present invention which typically comprises an anchor member 70 and a cover member 72. The anchor member 70 has a continuous anchoring wall portion 74 which generally has outer dimensions substantially similar to the inner dimensions of the edge region 26 (shown in FIG. 5) of the box 10. Since the typical box 10 defines a rectangular edge region 26, the anchoring wall portion 74 also defines a rectangle of substantially similar dimensions to the rectangle defined by the edge region 26. The similar dimensions of the anchoring wall portion 74 and the edge region 26 allow for the two to come into an abutting relation to each other. The abutting relation allows for an interconnection between the anchoring wall portion 74 and the edge region 26, and thus the box 10.

The anchor member 70 and the anchoring wall portion 74 thereof are preferrably constructed of a plastic material. The sides 75 and 76 of the anchoring wall portion 74 which support the longest side of the rectangular box 10 typically have a triangular shape which generally drops lower into the box 10 than the other walls of the anchoring wall portion 74. This is to allow the greatest resistance to flexing from the side 34 of the box 10 which will receive the greatest amount of compressive force from manual use of the box 10.

The anchoring wall portion 74 is typically constructed of a plastic material which has a stiffness coefficient of less than one-tenth (0.10) millimeters per ounce over the material's elastic range. Preferrably, the stiffness coefficient of the plastic material of the anchoring wall portion 74 is approximately the same as the material of which the box 10 is constructed. However, it is within the limits of the present invention for the anchoring wall portion 74 material to have a stiffness coefficient of between about three one-hundredths (0.03) millimeters per ounce and about one-tenth (0.10) millimeters per ounce over the anchoring wall portion 74 material's elastic range if it is desired that the stiffness of the anchoring wall portion 74 be greater than the stiffness of the box 10 material. This might be desired in containers which, because of their dimensions, require the greater stiffness in the anchoring wall portion 74.

The anchor member 70 may also include a disposeable sealing portion 90 (shown only in FIG. 3) which covers the opening 80 (seen in FIG. 2) defined by the anchor member 70. The sealing portion 90 is typically constructed of wax paper or aluminum foil and is preferrably molded into the lip portion 78. The sealing portion 90 is manually and permanently removeable when the box 10 is first opened. Its purpose is to provide an extra substantially air-tight seal of the opening 80 during the shelf life of the contents of the box 10 and during shipment.

The interconnection between the anchoring wall portion 74 and the edge region 26 of the box 10 typically includes a means for sealing the interconnection in a substantially air-tight relation. Such sealing means typically consists of glueing the areas of the anchoring wall portion 74, the edge region 26 and the box 10 which are in abutting relation. Since the box 10 is typically constructed of paperboard and the anchoring wall portion 74 is typically constructed of plastic, the glue should be of the type which is compatable with both paperboard and plastic. In addition, it is preferrable that the glue be of the type which is elastic in nature to allow the interconnection between the anchoring wall portion 74 and the box 10 to flex during compressions on the box 10 and still provide an substantially air-tight seal. The preferred glue would be any of the rubber cements.

The anchor member 70 typically includes a rigid edge region 73, shown only in FIG. 5. This rigid edge region 73 typically comprises a continuous and rigid lip portion 78 which protrudes perpendicular to the anchoring wall portion 74 and protrudes toward the edge region 26 of the box 10. This rigid lip portion 78 is interconnectable with the cover member 72 which will be described in more detail later. The anchor member 70 may be molded from a single piece of plastic material. The molding process is preferrably done in one step. The plastic material is heated and poured into a mold of the desired dimensions and the plastic material is elongated to form the anchoring wall portion 74 and concentrated in density to form the rigid lip portion 78. This elongation and concentration will allow the lip portion 78 to be sufficiently rigid to interconnect in an air-tight relation with the cover member 72 and will allow the anchoring wall portion 74 to be relatively less stiff. Thus, the anchor member 70 may be molded in one step to form the lip portion 78 and anchoring wall portion 74 with the desired characteristics.

The cover member 72 typically has a covering wall portion 82 and an interconnecting wall portion 84. When the present invention is interconnected to the typical rectangular box 10, the inner dimensions of a lip portion 86 are substantially similar to the rectangular outer dimensions of the anchoring wall portion 74. The interconnecting wall portion 84 is typically perpendicular to the plane defined by the covering wall portion 82 and provides a continuous horizontally opposed wall. The interconnecting wall portion 84 typically has the continuous lip portion 86 protruding inwardly and perpendicular with the interconnecting wall portion 84 with the continuous lip portion 86 also being horizontally opposed. The cover member 72 is typically constructed of a plastic material which will give sufficient rigidity to allow a snap-fitting and substantially air-tight relation when mated with the lip portion 78 of the anchor member 70. No special plastic molding process is contemplated for the cover member since there is no necessity of having any portion of a greater or less density, stiffness or thickness to any other portion.

The cover member 72 and the anchor member 70 come together to provide a removeable, reuseable and substantially air-tight closure of the flexible box 10.

Referring now to FIGS. 4 and 6, an alternative cover member 72 is seen. Alternatively, the cover member 72 may be hinged about a line 94. The hinging allowing the side 96 of the covering wall portion 82 to be raised above the plane defined by the covering wall portion 82 as shown in FIG. 6. Of course, a portion of the interconnecting wall portion 84 will accompany the side 96 when it is raised. Preferrably, the plastic material of the cover member 72 is molded in an open position as shown in FIG. 6. To prevent the open molded side 96 of the cover member 72 from opening too far, two bosses 98 and 99 are provided on the inward side 88 (shown only in FIG. 5) of the interconnecting wall portion 84. These bosses 98 and 99 catch on the lip portion 78 of the anchor member 70 to prevent the side 96 from extending beyond a desired angle. The placement of the bosses 98 and 99 is a matter of choice but the placement will affect the maximum angle relative to the covering wall portion 82 from which the side 96 will be allowed to deviate.

The side 96 will be openable by manually pulling on the front wall 100. It may be closed by pushing the side 96 back into a snap-fitting and substantially air-tight relation with the anchor member 70. This alternate embodiment of the cover member 72 is intended to be used on boxes 10 which contain granular substances which will easily pour. The preferred embodiment of the cover member 72, seen in FIGS. 3 and 5, is intended for boxes 10 which contain substances which do not pour out easily. Thus, this alternate cover member 72 also provides a removeable, reuseable and substantially air-tight closure for a flexible box.

Figure 7:
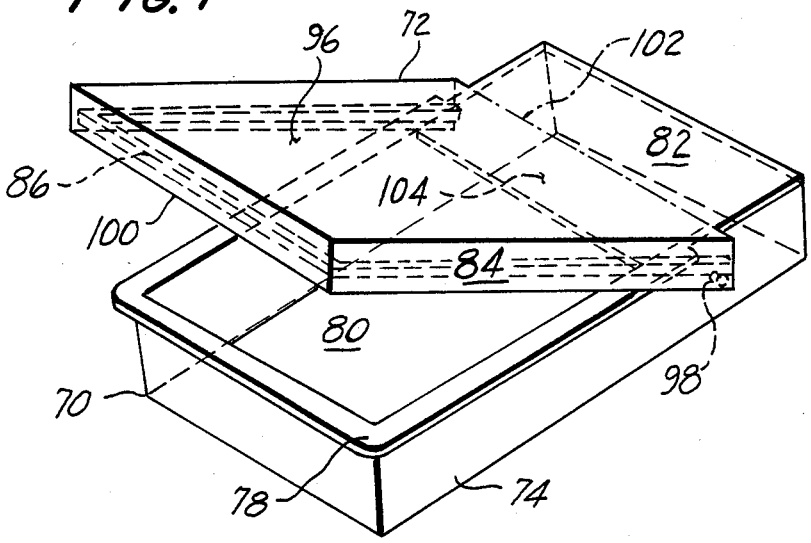
FIG. 7 is a perspective view of the hinged cover member of the present invention installed on the anchor member of the present invention.

Another alternate embodiment of the cover member 72 is seen in FIG. 7. The alternate embodiment of FIG. 7 is similar to the alternate embodiment of FIGS. 4 and 6 except that in FIG. 7, the cover member 72 and the anchor member 70 are an integrated whole with the cover member 72 attached to the anchor member 70 along line 102. The cover member 72 seals against the portion 104 (seen in dotted lines) which juts out from the anchor member 70. As well, the covering wall portion 82 is ended prematurely in FIG. 7 to leave the side 96 much longer than the covering wall portion 82. In all other ways, the alternate embodiment of FIG. 7 is used in the same way as the alternate embodiment of FIGS. 4 and 6.

The alternate embodiment of FIG. 7 is used primarily on containers (not shown) which contain granular contents such as baking goods and laundry soaps where a large opening is not necessary and there can be a savings in materials needed to construct the cover 72 and anchor 70 members.

The present invention also includes a method for providing a substantially air-tight and reuseable seal over the entire edge region 26 of the box 10. This method is also limited to containers contructed of a material which has a stiffness coefficient less than one-tenth (0.10) millimeter per ounce over the material's elastic range. The method typically includes interconnecting the anchor member with the edge region 26 of the box 10 for providing a rigid anchor on the edge region 26 of the box 10; sealing the interconnection between the anchor member 70 and the edge region 26 of the box as by glueing (previously described); interconnecting the cover member 72 (either the preferred or alternate embodiment) with the opening 80 defined by the anchor member 70; and, removeably sealing the interconnection between the anchor member 70 and the cover member 72 as by providing lip portions 78 and 86 to provide a removeable, reuseable and substantially air-tight seal of the opening 80 defined by the anchor member 70. The step of sealing the interconnection between the anchor member 70 and the edge region 26 of the box 10, and the step of removeably sealing the opening 80 defined by the anchor member 70 both act to provide a method of providing a removeable, reuseable and substantially air-tight closure of the box 10.

It has clearly been shown that the closure and method of providing such closure of the present invention has successfully provided a removeable, reuseable and substantially air-tight closure of a flexible container.

The preceeding disclosure of the preferred and alternate embodiments of the present invention are for illustrative purposes only and shall not be considered to define the scope of the present invention. Instead the scope of the present invention shall be defined by the following claims and their equivalents.

We claim:

1. In a container constructed of a material with a stiffness coefficient of less than one-tenth (0.10) millimeter per ounce over the wall material's elastic range and having a continuous edge region defining an opening in the container, a closure for providing a substantially air-tight and reuseable seal over the entire area of the container opening, the closure comprising:

a rigid anchor means interconnectable with the edge region of the container and defining an opening for providing a path for the movement of the contents of the container through the anchor means and for providing a rigid anchor on the edge region of the container;

a means for sealing the interconnection between the rigid anchor means and the edge region of the container in a substantially air-tight relation;

a cover means interconnectable with the opening defined by the anchor means for covering the opening defined by the anchor means; and, a means for removably sealing the interconnection between the rigid anchor means and the cover means for providing a removeable and resealable, substantially air-tight seal of the opening defined by the anchor means;

the substantially air-tight sealing of the interconnection of the anchor means and the edge region of the container and the substantially air-tight sealing of the opening defined by the anchor means both acting to provide a substantially air-tight and reusable seal of the container opening.

2. The closure in accordance with claim 1 in which the anchor means comprises:

an anchor member having a flexible and continuous anchoring wall portion constructed of a material with a stiffness coefficient of less than one-tenth (0.10) millimeters per ounce over the anchoring wall material's elastic range, and, the anchoring wall being interconnectable in abutting relation to the edge region of the container;

the anchor member having a rigid edge portion extending away from the container; and, the anchoring wall portion and the rigid edge portion of the anchor member defining an opening which allows the contents of the container to move within the continuous anchoring wall and through the anchor member.

3. The closure in accordance with claim 1 in which the anchor means comprises:

an anchor member having a flexible and continuous anchoring wall portion constructed of a material with a stiffness coefficient of between about three one-hundredths (0.03) millimeters per ounce and about one-tenth (0.10) millimeters per ounce over the anchoring wall material's elastic range, and, the anchoring wall being interconnectable in abutting relation to the edge region of the container;

the anchor member having a rigid edge portion extending away from the container; and, the anchoring wall portion and the rigid edge portion of the anchor member defining an opening which allows the contents of the container to move within the continuous anchoring wall and through the anchor member.

4. The closure in accordance with claim 2 in which the cover means comprises a cover member having a rigid edge portion and the means for sealing the anchor and cover means comprises;

a means for removeably sealing the rigid edge portion of the anchor member and the rigid edge portion of the cover member in a substantially air tight sealing relation;

the interconnection of the anchor member and the cover member providing a removeable, reuseable, and substantially air-tight seal of the container opening.

5. The closure in accordance with claim 4 in which the rigid edge portion of the cover member comprises a horizontally opposed interconnecting wall portion;

the outer dimensions of the anchoring wall portion of the anchor member being substantially similar to the inner dimensions of the edge region of the container;

the outer dimensions of the rigid edge portion of the anchor member being substantially similar to the inner dimensions of the horizontally opposed interconnecting wall portion of the cover member; and, the means for sealing the rigid edge portions of the anchor and cover members further comprises:

a continuous lip portion of the anchor member protruding perpendicular to the anchoring wall portion along the periphery of the rigid edge portion of the anchor member;

the lip protruding toward the edge region of the interconnected container;

a continuous lip portion of the cover member protruding inwardly along the opposed interconnecing wall portion of the cover member;

the cover and anchor members coming together in substantially air-tight, snap-fitting relation to provide a removeable, reuseable, and substantially air-tight seal of the container opening.

6. The closure in accordance with claim 5 in which the edge region of the container, the anchoring wall of the anchor member, and the rigid edge portion of the anchor member each define a rectangle with each rectangle having substantially similar dimensions, the cover member further comprising:

a rectangular and substantially flat covering wall portion;

the continuous interconnecting wall portion extending perpendicularly from the covering wall, and, the interconnecting wall portion having the continuous lip protruding inwardly and perpendicular with the interconnecting wall portion with the continuous lip portion being horizontally opposed and the inner dimensions of the continuous lip portion of the interconnecting wall portion being substantially similar to the rectangular outer dimensions of the anchoring wall of the anchor member.

7. The closure in accordance with claim 6 in which the covering wall portion of the cover member is hinged along a line perpendicular to the sides of the rectangular covering wall portion which are of the longest length;

the interconnecting wall portion of the cover member having two breaks in continuity with each break in continuity having one point of intersection with the line of hinging of the covering wall; and, one side of the the covering wall portion and the accompanying interconnecting wall portion of the cover member being moveable from a plane defined by the substantially flat and rectangular covering wall of the cover member.

8. The closure in accordance with claim 7 in which the side of the covering wall of the cover member which is moveable from the plane defined by the covering wall is molded in a naturally tilted position, tilted from the plane defined by the rectangular covering wall and the cover member further includes a preventing means for preventing the tilted side of the covering wall from tilting away from the plane defined by the covering wall by more than a selected angle.

9. The closure in accordance with claim 8 in which the preventing means further comprises two bosses each juxtaposed to the breaks in continuity of the interconnecting wall portion of the cover member on that side of the interconnecting wall which accompanies the covering wall portion and tilts away from the plane defined by the covering wall portion of the cover member.

10. The closure in accordance with claim 9 in which the cover member and the anchor member are constructed of a plastic material.

11. The closure in accordance with claim 10 in which the anchor member further includes a disposable sealing portion which covers the area of the anchor member defining an opening, the sealing portion being attached to the anchor member so that the area defining an opening in the anchor member is sealed in a substantially air-tight manner;

the sealing portion being manually and permanently removeable from the anchor member.

12. The closure in accordance with claim 3 in which the cover means comprises a cover member having a rigid edge portion and the means for sealing the anchor and cover means comprises;

a means for removeably sealing the rigid edge portion of the anchor member and the rigid edge portion of the cover member in a substantially air tight sealing relation;

the interconnection of the anchor member and the cover member providing a removeable, reuseable, and substantially air-tight seal of the container opening.

13. The closure in accordance with claim 12 in which the rigid edge portion of the cover member comprises a horizontally opposed interconnecting wall portion;

the outer dimensions of the anchoring wall portion of the anchor member being substantially similar to the inner dimensions of the edge region of the container;

the outer dimensions of the rigid edge portion of the anchor member being substantially similar to the inner dimensions of the horizontally opposed interconnecting wall portion of the cover member; and, the means for sealing the rigid edge portions of the anchor and cover members further comprises:

a continuous lip portion of the anchor member protruding perpendicular to the anchoring walls along the periphery of the rigid edge portion of the anchor member;

the lip protruding toward the edge region of the interconnected container;

a continuous lip portion of the cover member protruding inwardly along the opposed interconnecing wall portion of the cover member;

the cover and anchor members coming together in substantially air-tight, snap-fitting relation to provide a removeable, reuseable, and substantially air-tight seal of the container opening.

14. The closure in accordance with claim 13 in which the edge region of the container, the anchoring wall of the anchor member, and the rigid edge portion of the anchor member each define a rectangle with each rectangle having substantially similar dimensions, the cover member further comprising:

a rectangular and substantially flat covering wall portion;

the continuous interconnecting wall portion extending perpendicularly from the covering wall, and, the interconnecting wall portion having the continuous lip protruding inwardly and perpendicular with the interconnecting wall portion with the continuous lip portion being horizontally opposed and the inner dimensions of the continuous lip portion of the interconnecting wall being substantially similar to the rectangular outer dimensions of the anchoring wall portion of the anchor member.

15. The closure in accordance with claim 14 in which the covering wall portion of the cover member is hinged along a line perpendicular to the sides of the rectangular covering wall portion which are of the longest length;

the interconnecting wall portion of the cover member having two breaks in continuity with each break in continuity having one point of intersection with the line of hinging of the covering wall; and, one side of the the covering wall portion and the accompanying interconnecting wall portion of the cover member being moveable from a plane defined by the substantially flat and rectangular covering wall of the cover member.

16. The closure in accordance with claim 15 in which the side of the covering wall of the cover member which is moveable from the plane defined by the covering wall is molded in an naturally tilted position, tilted from the plane defined by the rectangular covering wall and the cover member further includes a preventing means for preventing the tilted side of the covering wall from tilting away from the plane defined by the covering wall by more than a selected angle.

17. The closure in accordance with claim 16 in which the preventing means further comprises two bosses each juxtaposed to the breaks in continuity of the interconnecting wall portion of the cover member on that side of the interconnecting wall which accompanies the covering wall portion and tilts away from the plane defined by the covering wall portion of the cover member.

18. The closure in accordance with claim 17 in which the cover member and the anchor member are constructed of a plastic material.

19. The closure in accordance with claim 18 in which the anchor member further includes a disposable sealing portion which covers the area of the anchor member defining an opening, the sealing portion being attached to the anchor member so that the area defining an opening in the anchor member is sealed in a substantially air-tight manner;

the sealing portion being manually and permanently removeable from the anchor member.

20. The closure in accordance with claim 17 in which the cover member and anchor members are interconnected along a plane such that the side of the covering wall portion which is moveable from the plane defined by the covering wall portion rotates about an axis coincident with the plane of interconnection between the anchor and cover members.

21. In a container constructed of a material with a stiffness coefficient of less than one-tenth (0.10) millimeter per ounce over the wall material's elastic range and having a continuous edge region defining an opening in the container, a method for providing a substantially air-tight and reuseable seal over the entire area of the container opening, the method comprising the following steps:

interconnecting a rigid anchor means with the edge region of the container, the rigid anchor means defining an opening for providing a path for the movement of the contents of the container through the anchor means and for providing a rigid anchor on the edge region of the container;

sealing the interconnection between the rigid anchor means and the edge region of the container in a substantially air-tight relation;

interconnecting a cover means with the opening defined by the anchor means to provide a covering for the opening defined by the anchor means; and, removably sealing the interconnection between the rigid anchor means and the cover means, providing a removeable, reuseable and substantially air-tight seal of the opening defined by the anchor means;

the step of sealing the interconnection of the anchor means and the edge region of the container and the step of removeably sealing the opening defined by the anchor means both acting to provide a method of providing a removeable, reuseable and substantially air-tight seal of the container opening.

* * * * *